US005564712A

United States Patent [19]

Werner

[11] Patent Number: 5,564,712

[45] Date of Patent: Oct. 15, 1996

[54] BULLET TRAP

[76] Inventor: Torsten Werner, Åkerby, Hjälmsta, S-740 22 Bälinge, Sweden

[21] Appl. No.: 617,844

[22] PCT Filed: Sep. 26, 1994

[86] PCT No.: PCT/SE94/00886

§ 371 Date: Mar. 13, 1996

§ 102(e) Date: Mar. 13, 1996

[87] PCT Pub. No.: WO95/09342

PCT Pub. Date: Apr. 6, 1995

[30] Foreign Application Priority Data

Sep. 27, 1993 [SE] Sweden ..... 9303140

[51] Int. Cl.[6] ..... F41J 1/12

[52] U.S. Cl. ..... 273/410

[58] Field of Search ..... 273/410, 404; 89/36.02, 36.01

[56] References Cited

U.S. PATENT DOCUMENTS 4,164,901 8/1979 Everett .
4,317,572 3/1982 Iseli ..... 273/404 X
4,773,653 9/1988 Unverzagt ..... 273/410 X
4,818,946 4/1989 Kahler ..... 273/404 X
4,856,791 8/1989 McQuade .

*Primary Examiner*—Paul E. Shapiro
*Attorney, Agent, or Firm*—Young & Thompson

[57] ABSTRACT

In a bullet trap for indoor shooting with small arms, which bullet trap, behind the targets, includes a vertically suspended curtain (1) made of rubber, and a vertically supported impact plate (3) made of steel and being spaced behind the curtain, the space between the curtain and the impact plate is enclosed by cover plates (4, 4', 5, 6) extending forwards from the side, upper and lower margins of the impact plate, covering the space between the impact plate and the curtain, whereby the latter is sealingly attached to the front edges of the cover plates through steel profiles (9), attached to the cover plates by screwing through the curtain. The enclosed space is continuously evacuated by connected fan means (10) and an interconnected filter (12) to prevent that lead containing dust, which is set free upon the impact of the bullets in the bullet trap, is distributed to the air and the shooting premises.

4 Claims, 1 Drawing Sheet

BULLET TRAP

Figure 1:
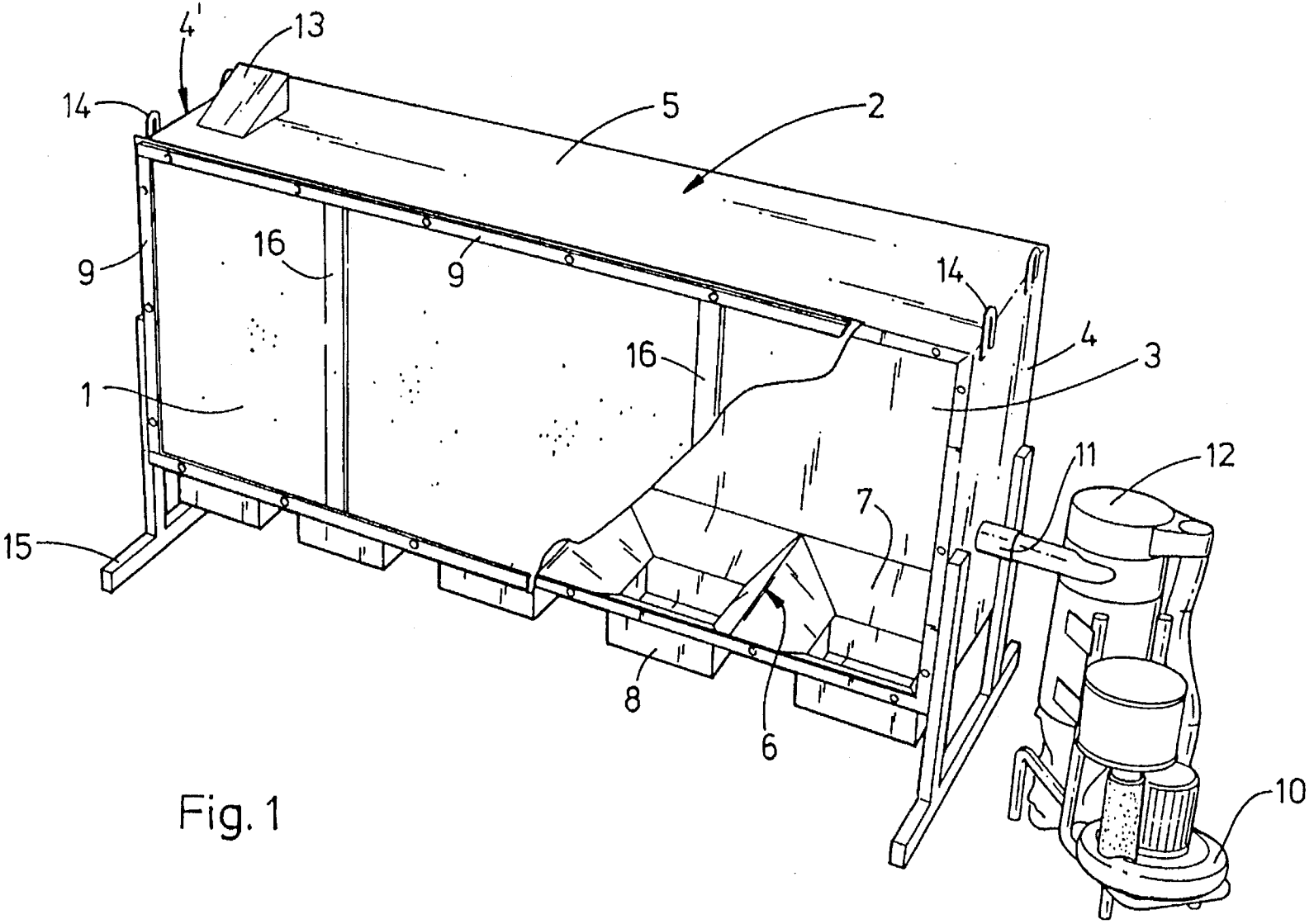

The present invention relates to a bullet trap for indoor shooting, which trap significantly reduces the distribution of lead contaminated dust that is connected with indoor shooting.

Among shooters it is commonly known, that considerable amounts of lead contaminated dust is set free upon shooting and accordingly mixed with the air. The problem is of course particularly apparent in connection with indoor shooting, where the amount of lead in the breathing air can be large enough to be detectable in the shooter's blood. This danger to the health is so obvious and substantial that limitation of gun training have been discussed and also realized.

The lead particles that are set free upon shooting arise mainly from two sources: partly from the cap charge, which is believed to produce 30–40% of the distributed lead, partly from the bullet, which produces 60–70% of the lead.

At the firing moment, a certain amount of lead is detached from the back end plane of the bullet, where the bullet usually has no jacket and is subjected to high pressure and hot gases as it is pushed through the bore. This problem is sufficiently solved by attaching a separate plate to the end plane, which plate is folded over by the surrounding jacket, or by electrolythically applying a jacket material. The major distribution of lead particles arise when the bullet hits the bullet trap, where the bullet is splintered and detached from its jacket.

Conventionally, the bullet trap comprises a vertically standing steel plate, with a thickness of 10–15 mm, in front of which a curtain made of synthetic fibres or rubber is suspended to prevent ricochets from the steel plate. The bullet penetrates the curtain and is subsequently splintered against the plate. Through the contractibility of the material in the curtain, the bullet will only leave a very small hole in the curtain. However, the curtain has no ability to shield the shooting range from the lead contaminated air, which exists in the space between the curtain and the steel plate. Due to the generation of heat, caused by the impact of the bullets with the plate, and due to the turbulence that is caused by the velocity of the bullet, a considerable air circulation is produced behind the curtain, whereby this air strives to pass the curtain through openings at the floor, the ceiling and the sides of the curtain.

Among attempts to reduce the amount of lead in the air reference is made to the procedure of suspending multiple curtains behind each other. Since each curtain contributes to the retardation of the bullet, it has lost sufficient energy not to splinter at the impact with the plate. The drawback of this solution is that it is very costly, because all curtains must be simultaneously replaced when the target area has received enough bullets to reduce the retardation effect.

Another solution to the problem is to install, behind the targets, a backwards tapering funnel of steel, with a circular drum connected to its back end taper. The bullets are trapped within the wide opening of the funnel, bounces backwards to the drum where they rotate till they have lost their energy, where upon they fall out of the drum, and are collected, comparatively undamaged. On the inside, the funnel is sprinkled with water or oil spray to produce a lubricating effect that will spare the funnel and the drum and to flush the bullets out of the bullet trap. The draw back of this solution is likewise the great costs and the funnel also requires a large installation space which precludes the utilization of the funnel in most existing shooting premises.

To reduce the amount of lead particles in the air, the present invention provides a device which readily can be installed in existing shooting premises through being space saving, and which is not associated with above said great costs for replacement of curtains for the bullet trap.

Briefly, the invention includes forming of a closed space between the curtain and the steel plate, and connecting the closed space to a device for continuous evacuation and dust separation.

Accordingly, the object of the invention is to provide a closed space for trapping the bullet, which space is shielded from the shooter, continuously evacuated and cleaned from lead particles.

This object is met with in a device according to claim 1.

The invention will now be described more in detail in conjunction with the attached drawing, illustrating a preferred embodiment of the invention, showing in FIG. 1 a diagrammatic, partly fragmentary perspective view of a preferred embodiment of the bullet trap of the invention.

In the preferred embodiment, the inventive bullet trap comprises a vertically suspended curtain 1, positioned behind the target and attached to a steel frame, commonly referred to by the reference number 2. The curtain 1 is made from synthetic material or non-reinforced rubber and is composed from several lengths, vulcanized together to form an integrated curtain 1 of required width. The frame 2 is mounted to a vertically standing impact plate 3, which is positioned behind and spaced from the curtain 1, and on to which the bullets are splintered on impact. The word "vertically" should here be understood as substantially vertically oriented to the floor, and may also include an impact plate 3 which comprises a slanting or inclined orientation, thus directing the ricochetting bullets downwards or upwards. The frame 2 is for example attached to the impact plate 3 by welding, and extends forward from the side, lower and upper edges of the plate, and the distance between the curtain 1 and impact plate 3 is optional but is preferably chosen to be about 60 cm. The frame 2 includes flat, covering side plates 4, 4', a flat roof plate 5 and a bottom plate 6, wherein the later is formed with tapering hoppers 7. Detachable boxes 8 for collecting the bullet and jacket remains are coupled to the lower end of a resp. hopper 7. The boxes 8 can for example be slidably supported in guide rails in the lower edges of the hoppers, or be suspended with the aid of hooks or clamps, whereby it must be made sure that the connections are air tight. The fastening of the boxes is however an easy task for a man skilled in the art of mechanics, and is not shown in detail since it is not crucial for explaining the operation of the bullet trap. The curtain 1 is peripherally sealed to the cover plates 4, 4', 5 and to the bottom plate 6 for example with the aid of externally positioned steel profiles 9, as is shown in the drawing, wherein the profiles 9 are secured by bolts which are screwed through the curtain 1 and into inwardly bent sections of the front edges of the cover plates and of the bottom plate. Alternatively, the curtain is attached to the frame by folding its margin sections onto the outside of the cover plates and bottom plate (not shown in the drawing). In one preferred embodiment, the inwardly bent sections of the front edges of the cover plates comprise fixed, protruding and threaded bolts, on to which the curtain is suspended through corresponding holes, where upon the steel profiles 9 are secured by nuts. By this arrangement is formed a closed space for trapping the bullets, a space which is shielded from the shooter.

The bullet trap is connected, for example through one of the side plates 4, to an evacuation equipment or a fan assembly 10, for evacuating the closed space between the curtain 1, the steel plate 3 and the cover plates 4, 4', 5 and 6 through a duct 11. On its way to the fan assembly 10, the lead contaminated air from the closed space passes un interconnected dust separation unit or a filter 12, in which particles are trapped and removed from the air. The evacuation equipment 10 and the dust separation unit 12 are of conventional and commercially available construction, and can for example be of the type that is sold under the trademark Dustcontrol. The cleaned air is then optionally returned to the shooting premises or passed to the open air outside. The bullet trap includes an air inlet 13, for example as in FIG. 1 attached to the roof plate 5, through which the evacuated air is replaced. It is naturally within the scope of invention to design an embodiment, comprising more than one fan assemblies and dust separation units or more than one evacuation ducts or air inlets, in cases where this is considered to be required for example due to the dimensions of the bullet trap.

The complete bullet trap can be suspended in chains or rods (not shown), connected to loops 14, which are protruding from the frame 2. The bullet trap can also as is shown in the drawing be supported by two or more support members 15, attached to the side plates 4, 4' and to the side edges of the impact plate 3, e.g. by welding. The support members can alternatively be equipped with wheels to make the assembly easy to move.

The bullet trap has generally a height of about 1.5–2 m, and the width varies to the number of targets or gun ranges. In order to stabilize the rubber mat or curtain 1 and support it so as not to curve inwards as a result of a possibly lower pressure in the closed space behind the curtain, the later can advantageously be equipped with vulcanized, vertically attached support strips 16 made of rubber, between each target area.

In shooting premises with existing bullet traps in the form of fixedly mounted impact plates, the invention can be practiced by mounting the cover plates 4, 4', 5 and bottom 6 to the existing impact plate.

When advantageous, the invention can even be practiced in an embodiment which includes that the closed space between the curtain 1 and the impact plate 3 is formed by a front wall, detaching a space from the shooting premises. Curtain 1 is sealingly attached to the wall frame, in the side, upper and lower margins of the wall. Slidably mounted boxes near the floor facilitates removal of bullet and jacket remains. In this embodiment, the evacuation equipment and the dust separation unit are placed on the outside of the shooting premises, and the evacuation duct passes the wall of the housed shooting range. This embodiment is particularly well adapted for creating the closed, evacuated space between the curtain 1 and the impact plate 3 in the case where the bullet trap is equipped with an angularly mounted plate, against which the bullet ricochets downwards, and therefore requires a longer installation depth for the assembly.

With the inventive bullet trap a significant reduction of the amount of lead particles in the air is achieved. With the high capacity of existing dust separation equipments and by using lead free caps and bullets with completely surrounding jackets, lead contamination of the air in the shooting premises can practically be eliminated in combination with the invention, even if the cleaned air is returned to the housed shooting range. A positive side effect is also that the noise from the bullets impact in the bullet trap is reduced, which of course is advantageous for the surroundings.

I claim:

1. A bullet trap for indoor shooting including, a vertically suspened curtain (1) and a substantially verticaly supported impact plate (3), spaced behind the curtain, characterized by the space between curtain (1) and the impact plate (3) being enclosed and shielded from the shooting premises in which the trap is located, and by fan means (10) connecte to the enclosed space for continuously evacuating air therefrom and a dust separation unit (12) for cleaning lead particles from the evacuated air.

2. Bullet trap according to claim 1, characterized by a frame (2) with side top and bottom cover plates (4, 4', 5, 6) attached to the impact plate (3), wherein the cover plates extend forward from the side, upper and lower margins of the impact plate, the curtain (1) being sealingly attached to the front edges of the cover plates (4, 4',5, 6) through outwardly positional steel profiles (9), secured by bolts to the plates (4, 4', 5, 6), through the curtain (1), the fan means (10) and dust separation unit (12) being interconnected and being connected to the enclosed space through one or some of the cover plates (4, 4', 5) by at least one evacuation duct (11), and at least one air inlet (13), connected to the enclosed space through at least one of the cover plates (4, 4', 5).

3. Bullet trap according to claim 2, characterized by at least one hopper (7) formed in the bottom plate at least one box (8) for collecting bullet and jacket remains detachably supported in the lower end of the hopper (7), formed in the bottom plate (6), and by the bullet trap comprising suspension means in the form of loops (14) and/or support members (15).

4. Bullet trap according to claim 1 characterized by at least a bottom plate (6) extending forwardly from the lower margin of the impact plate, at least one hopper (7) formed in the bottom plate at least one box (8) for collecting bullet and jacket remains detachably supported in the lower end of the hopper (7), and the bullet trap comprising support means in the form of suspension loops (14) and/or support members (15).

* * * * *